US011121505B2

(12) United States Patent
Vollmer et al.

(10) Patent No.: US 11,121,505 B2
(45) Date of Patent: Sep. 14, 2021

(54) LOCKING DEVICE FOR A PLUG CONNECTION

(71) Applicant: HARTING ELECTRIC GMBH & CO. KG, Espelkamp (DE)

(72) Inventors: Christian Vollmer, Herford (DE); Till Riechmann, Stemwede (DE); Malte Frerking, Brockum (DE)

(73) Assignee: Harting Electric GmbH & Co. KG, Espelkamp (DE)

( * ) Notice: Subject to any disclaimer, the term of this patent is extended or adjusted under 35 U.S.C. 154(b) by 0 days.

(21) Appl. No.: 16/638,441

(22) PCT Filed: Aug. 6, 2018

(86) PCT No.: PCT/DE2018/100686

§ 371 (c)(1),
(2) Date: Feb. 11, 2020

(87) PCT Pub. No.: WO2019/034201

PCT Pub. Date: Feb. 21, 2019

(65) Prior Publication Data

US 2020/0169039 A1 May 28, 2020

(30) Foreign Application Priority Data

Aug. 17, 2017 (DE) ..... 10 2017 118 751.0

(51) Int. Cl.

| | |
|---|---|
| ***H01R 13/639*** | (2006.01) |
| ***H01R 13/627*** | (2006.01) |
| ***H01R 13/70*** | (2006.01) |

(52) U.S. Cl.
CPC ..... *H01R 13/639* (2013.01); *H01R 13/6276* (2013.01); *H01R 13/70* (2013.01)

(58) Field of Classification Search
CPC ... H01R 13/639; H01R 13/6276; H01R 13/70
See application file for complete search history.

(56) References Cited

U.S. PATENT DOCUMENTS

| | | | |
|---|---|---|---|
| 6,786,753 | B1 | 9/2004 | Lai |
| 2004/0002249 | A1 | 1/2004 | Yamada et al. |
| 2010/0140964 | A1 | 6/2010 | Schmidt et al. |

(Continued)

FOREIGN PATENT DOCUMENTS

| | | | |
|---|---|---|---|
| DE | 32 20 839 | C2 | 4/1985 |
| DE | 10 2008 060 561 | A1 | 7/2010 |

(Continued)

OTHER PUBLICATIONS

Krause, W., Konstruktions-elemente der Feinmechanik, Bd. 1, 3., Hanser 2004, pp. 448-449.

(Continued)

*Primary Examiner* — Abdullah A Riyami
*Assistant Examiner* — Nader J Alhawamdeh
(74) *Attorney, Agent, or Firm* — Seed IP Law Group LLP

(57) ABSTRACT

A system is provided comprising of a first plug module and a second plug module, which can be plugged together, wherein the first plug module has a locking arrangement, whereby the plug modules can be reversely locked to each other. The system can be arranged within the housings of industrial plugs and is thus better protected from mechanical loads.

13 Claims, 1 Drawing Sheet

(56) References Cited

U.S. PATENT DOCUMENTS

| | | | | |
|---|---|---|---|---|
| 2014/0223587 | A1* | 8/2014 | Chen | G06F 21/88 726/35 |
| 2020/0169039 | A1* | 5/2020 | Vollmer | H01R 13/6276 |

FOREIGN PATENT DOCUMENTS

| | | | | |
|---|---|---|---|---|
| DE | 10 2009 039 652 | A1 | 3/2011 | |
| DE | 102009039652 | A1 * | 3/2011 | B60L 53/16 |
| DE | 10 2011 004 648 | A1 | 8/2012 | |
| DE | 10 2013 113 976 | B4 | 10/2016 | |
| DE | 10 2016 105 975 | A1 | 10/2017 | |
| WO | 90/15282 | A1 | 12/1990 | |
| WO | WO-9015282 | A1 * | 12/1990 | F16B 21/04 |

OTHER PUBLICATIONS

European Patent Office, International Search Report for international application No. PCT/DE2018/100686, dated Nov. 7, 2018, 7 pages (with English translation).

German Patent Office, Office Action for German application No. 10 2017 118 751.0, dated Jun. 28, 2018, 7 pages.

International Preliminary Report on Patentability, dated Feb. 18, 2020, for International Application No. PCT/DE2018/100686, 6 pages.

* cited by examiner

LOCKING DEVICE FOR A PLUG CONNECTION

BACKGROUND

Technical Field

The disclosure relates to a system comprising two plug connector modules which can be locked reversibly together. Such plug connector modules are generally used in modular industrial plug connectors. The industrial plug connectors can be fitted with different plug connector modules, as a result of which such plug connectors can be used in a particularly versatile manner in industry.

The plug connector modules are inserted into what are known as holding frames which are in turn screwed into industrial plug connector housings. DE 10 2013 113 976 B4 shows such a holding frame for a heavy plug connector for receiving similar and/or different plug connector modules. The holding frame comprises a base body which has two side parts which lie opposite one another. In each case a cheek part, composed of a flexible material, is fitted on the side parts. When a plug connector module is inserted into the holding frame, these cheek parts are bent to the outside away from the side part, as a result of which the plug connector modules are fixed in a plane within the base body.

A mechanical locking is required in order to ensure a reliable connection of a plug connector and a mating plug connector. As a result of this, the plug connection is protected from unintentional opening. Industrial plug connectors are generally locked together with the aid of locking brackets fitted on the outside of the housing.

Description of the Related Art

Locking devices fitted on the outside of the housing of the plug connectors can be easily damaged, for example, in the case of a plug connector falling out. Plug connectors with a locking device arranged within the housing are therefore also known.

DE 10 2008 060 561 B4 shows, for example, a plug connector with an internal locking device. Here, a spring steel sheet is arranged on the inside of a plug, which spring steel sheet is provided for latching with a latching lug arranged on the inside of a mating plug. A push button is arranged on the outside of the plug, which push button projects through the wall of the plug and acts on the spring steel sheet such that the latching of the latching lug can be released.

Such locking devices often have a mechanically very complex structure and therefore can only be produced at a high cost. Moreover, such mechanical solutions cannot be controlled electronically.

The German Patent and Trademark Office researched the following prior art in the priority application in relation to the present application: DE 10 2009 039 652 A1, DE 32 20 839 C2, DE 10 2011 004 648 A1, DE 10 2016 105 975 A1.

The following non-patent literature was furthermore also researched by the German Patent and Trademark Office:

KRAUSE, Werner: Konstruktionselemente der Feinmechanik. Vol. 1, 3rd, updated Edition. Munich: Hanser 2004. Page 448-449.

BRIEF SUMMARY

Embodiments of the invention provide a system of plug connector modules which can be locked reversibly to one another, which system is embodied to have a simple structure, be mechanically stable and at the same time low-cost.

The system according to an embodiment of the invention comprises a first plug connector module and a second plug connector module. The plug connector modules are generally integrated in each case in an industrial plug connector and arranged opposite one another. The industrial plug connectors and thus the plug connector modules can be plugged together. Here, one plug connector module engages in the other plug connector module. The first plug connector module has a locking means, as a result of which the plug connector modules can be locked reversibly to one another.

As a result of the locking of the plug connector modules, the plug connectors which contain the plug connector modules are also locked to one another. The plug connector modules thus represent the above-mentioned locking device for the industrial plug connectors. The plug connector modules are protected within the housing of the respective industrial plug connector.

In one advantageous configuration of the invention, the locking means is a camshaft. A camshaft is a machine element in the form of a rod on which at least one rounded projection, what is known as a "cam", is fitted. The rod rotates about its own axis, as a result of which the cams fitted on it perform a longitudinal movement (perpendicular to the extension of the rod).

The axis of rotation of the camshaft is advantageously oriented parallel to the plug direction of the first plug connector module. The camshaft can thus be integrated in a space-saving manner in the plug connector module.

The first plug connector module preferably has an electric motor with which a rotational movement of the camshaft can be brought about. The electric motor can be supplied with power, for example, via conductors connected to the plug connector module. A power supply via a battery integrated in the plug connector module is also conceivable.

In one particularly advantageous variant of the invention, the first plug connector module has a pin which projects in the plug direction. The camshaft runs at least partially in this pin. This means that the camshaft protrudes at least partially into the projecting pin. The pin is embodied here as a cuboid extension which can be plugged into a receiver, provided for this purpose, of a mating plug connector module. The second plug connector module has a receiver. In the plugged state, the pin and thus also the camshaft located therein of the first plug connector module penetrate into the receiver of the second plug connector module.

The pin of the first plug connector module preferably has at the end side at least one hole. The hole runs transversely to the direction of extension of the pin. A ball is arranged in the hole. Two corresponding holes are ideally present in the pin, which holes are arranged opposite one another and in which in each case a ball is arranged. The balls are preferably manufactured from steel or a hard plastic and serve to lock the first plug connector module to the second plug connector module. The precise mode of operation is explained in greater detail below.

The receiver of the second plug connector module preferably has at least one hole which corresponds to the hole of the pin of the first plug connector module. The receiver also preferably has two holes which, in the plugged state, are opposite in each case a hole of the pin.

The camshaft of the first plug connector module is in operative contact with the balls located in the pin and arranged in its holes. The respective ball can be pushed by a rotational movement of the camshaft at least partially into the hole located in the receiver of the second plug connector module, as a result of which the first plug connector module and the second plug connector module can be locked to one another.

The camshaft has, in the region of the pin, a substantially oval or elliptical cross-section. This oval form can be understood as the "cam" of the camshaft already mentioned above with which the balls can be displaced transversely to the plug direction. If the diameter of the camshaft widens in the cross-sectional plane of the pin, the balls are driven at least partially out of the holes of the pin of the first plug connector module into the holes of the recesses of the second plug connector module. A pulling apart of the two plug connector modules is thus blocked by the balls. The plug connector modules are locked to one another. If the diameter of the camshaft in the cross-sectional plane of the pin is reduced in size, the balls can move back into the holes of the pin, as a result of which the locking of the plug connector modules is released. The plug connector modules can thus be shifted from a locked into an unlocked state.

At the end which is distant from the pin, the camshaft is connected to the electric motor. In this region, the camshaft has a substantially oval or elliptical cross-section which can be regarded as the "cam". This oval region is perpendicular to the oval region in the pin. This means that, if the camshaft in the region of the pin within the cross-sectional plane of the plug connector module has a large diameter, the diameter of the camshaft in the region of the electric motor becomes small and vice versa.

The camshaft can be regarded here as a rod with a total of two cams, a first cam in the region of the electric motor and a second cam in the region of the pin. Both cams are perpendicular to one another.

In one highly particularly advantageous variant of the invention, the first plug connector module has at least two buttons, a first button and a second button.

The first button is arranged in the region of the electric motor. The first button is touched or activated by the camshaft if the first plug connector module and the second plug connector module are not locked to one another. In this case, the first cam of the camshaft is guided against a switch of the first button and thus activates it.

The second button is arranged away from the electric motor in the direction of the pin of the first plug connector module. The second button is touched by a cam of the camshaft if the first plug connector module and the second plug connector module are locked to one another. In this case, the second cam of the camshaft is guided against a switch of the second button and thus activates it.

The plug connector modules advantageously have in each case an interface. In the state plugged together, the plug connector modules can exchange signals and/or data via the interface. This can involve, among other things, control signals which actuate the electric motor and thus initiate a locking and/or an unlocking of the plug connector modules. The interfaces can be embodied, for example, as plug connectors and associated sockets.

The first plug connector module and/or the second plug connector module preferably has/have an interface. Signals and/or data can be exchanged with an adjacent plug connector module via this. This interface can involve, for example, contact pins which can be brought into electrical contact with a holding frame in which the plug connector modules are located. For this purpose, the holding frame can have data lines and ensure a connection of the plug connector modules via a suitable data bus. For example, operating states of a machine can be transmitted via this to the plug connector modules, which operating states initiate or trigger a locking and/or an unlocking of the plug connector modules according to embodiments of the invention.

BRIEF DESCRIPTION OF THE SEVERAL VIEWS OF THE DRAWINGS

An exemplary embodiment of the invention is represented in the drawings and is explained in greater detail below. In the drawings.

The figures contain partially simplified, schematic representations. Identical reference numbers are used in part for similar, but possibly not identical elements. Different views of similar elements could have different scales.

DETAILED DESCRIPTION

Figure 1:
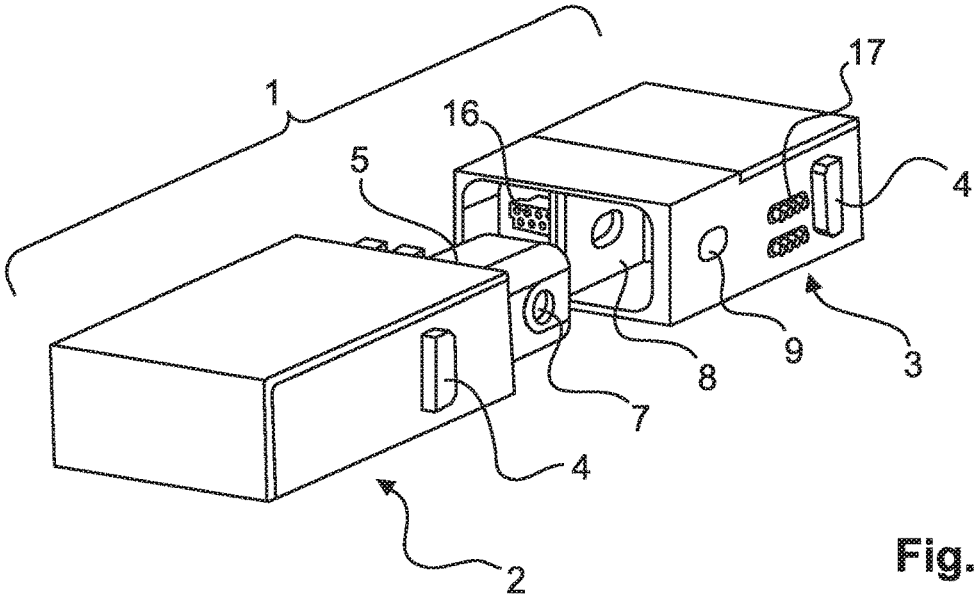
FIG. 1 shows a perspective representation of a system comprising a first plug connector module and a second plug connector module.
Figure 2:
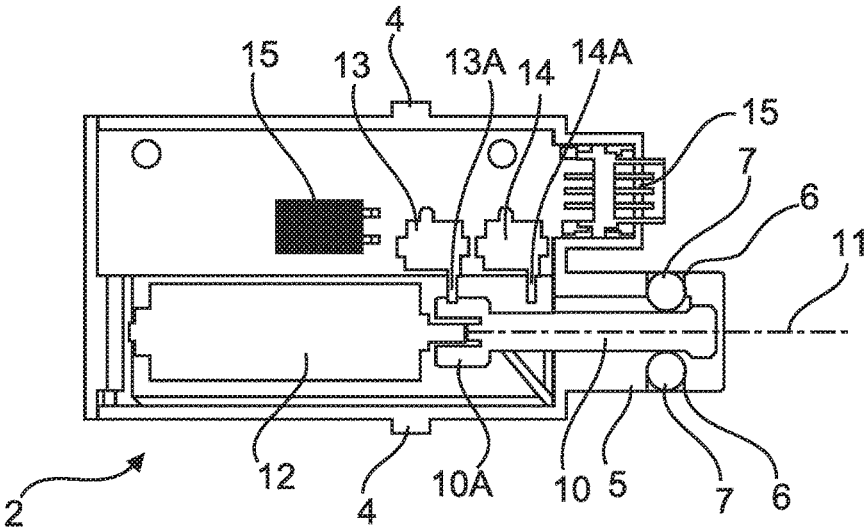
FIG. 2 shows a sectional representation of the first plug connector module.
Figure 3:
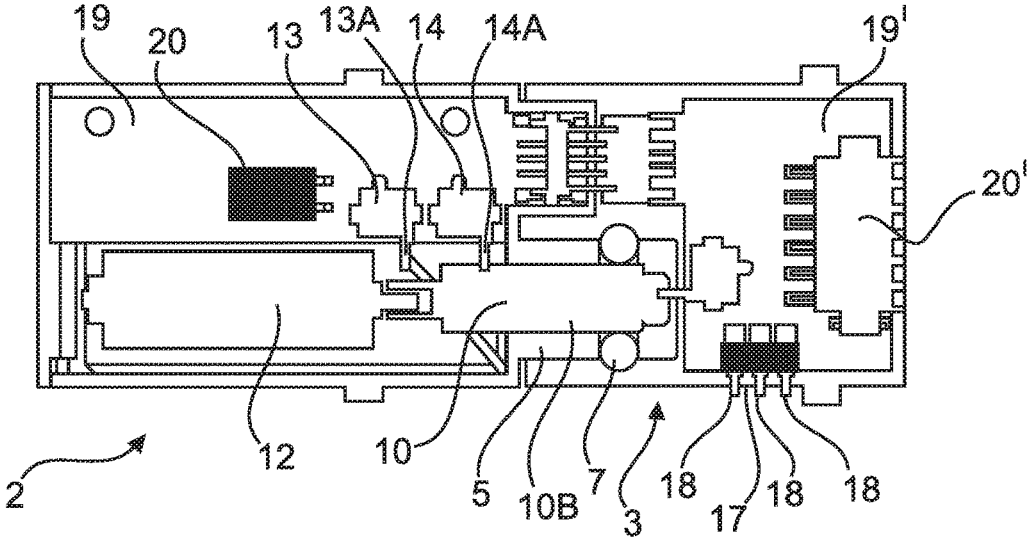
FIG. 3 shows a sectional representation of the first plug connector module and of the second plug connector module in the plugged state.

FIG. 1 shows a perspective representation of a system 1 comprising a first plug connector module 2 and a second plug connector module 3. Plug connector modules 2, 3 have a substantially cuboid basic form. Plug connector modules 2, 3 have on their narrow sides in each case holding pins 4 with which they can be fixed in a holding frame (not shown) of an industrial plug connector (not shown). The fixing process of plug connector modules 2, 3 in a holding frame is adequately described in DE 10 2013 113 976 B4.

First plug connector module 2 has a pin 5 which projects in the plug direction. Pin 5 is configured to be substantially cuboid. Holes 6 are incorporated or formed in the narrow sides of pin 5, in which holes 6 in each case a ball 7 is arranged. In the plugging process, pin 5 is guided into a receiver 8, provided for this, of second plug connector module 3. Holes 9 are incorporated or formed in the narrow sides of receiver 8. In the plugged state, holes 6 of pin 5 of first plug connector module 2 are flush with associated holes 9 of receiver 8 of second plug connector module 3.

A camshaft 10 is arranged in first plug connector module 2. Axis of rotation 11 of the camshaft 10 runs parallel to the plug direction of first plug connector module 1. Camshaft 10 extends largely within pin 5. At the end which is distant from pin 5, camshaft 10 is connected to an electric motor 12 with which a rotational movement of camshaft 10 can be brought about.

Camshaft 10 has two cams, a first cam 10A and a second cam 10B. Cams 10A, 10B essentially involve widened portions of the rod-shaped base form of camshaft 10. Cams 10A, 10B are perpendicular to one another in cross-section. Second cam 10B extends largely in pin 5 of first plug connector module 2. If second cam 10B is brought into touching contact with balls 7 by a rotational movement of camshaft 10, balls 7 are pushed out of holes 6 of pin 5 of first plug connector module 2 at least partially into holes 9 of receiver 8 of second plug connector module 3. In this state, plug connector modules 2, 3 plugged together can no longer be pulled apart. Plug connector modules 2, 3 are regarded as locked to one another in this state.

Two buttons 13, 14 are arranged in first plug connector module 2. Buttons 13, 14 have in each case a switch 13A, 14A via which respective buttons 13, 14 can be activated. First button 13 is located at the interface between electric motor 12 and camshaft 10 at the height of first cam 10A. Second button 14 is located distant therefrom in the plug direction at the height of second cam 10B of camshaft 10.

As already mentioned above, cams 10A, 10B of camshaft 10 are perpendicular to one another in cross-section. If first button 13 is activated via first cam 10A, balls 7 are not pushed by second cam 10B out of holes 7 of pin 5 into holes 9 of receiver 8. Plug connector modules 2, 3 are then in an unlocked state and can be pulled apart. If second button 14 is activated via second cam 10B, balls 7 are pushed by second cam 10B out of holes 7 of pin 5 into holes 9 of receiver 8. Plug connector modules 2, 3 are now in a locked state and cannot be pulled apart. The above-mentioned locking states can be monitored and also initiated via a microprocessor 20. Microprocessor 20 can correspondingly actuate electric motor 12. The locking states can be detected via buttons 13, 14.

First plug connector module 2 has a plugging extension 15 arranged next to pin 5. Contact elements are arranged in the plugging extension. Second plug connector module 3 has a socket 16 into which plugging extension 15 can be inserted in the plugging process. Plugging extension 15 and socket 16 form in each case an interface via which plug connector modules 2, 3 can exchange signals and/or data.

Second plug connector module 3 has, on a narrow side, an interface 17 which can be connected to a holding frame (not shown). Interface 17 has three contact pins 18. Via interface 17, second plug connector module 3 can communicate with other plug connector modules located in the holding frame and/or receive signals and/or data from a different point or transmit them to there. Via said interface 17, for example, the above-mentioned locking states can be communicated and/or a command to lock or unlock can be received.

Both plug connector modules 2, 3 have a circuit board 19, 19' and further electronic components, such as, for example, microprocessors 20, 20'. Via these components, plug connector modules 2, 3 can act independently according to programming and/or be actuated from the outside and execute commands.

Even if different aspects or features of the invention are shown in each case in combination in the figures, it is apparent for the person skilled in the art, unless indicated otherwise, that the represented and discussed combinations are not the only ones possible. In particular, corresponding units or feature complexes from different exemplary embodiments can be mutually exchanged.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. A system comprising a first plug connector module having a first plurality of electrical contact elements and a second plug connector module having a second plurality of electrical contact elements, which first and second plug connector modules can be plugged together with the first plurality of electrical contact elements engaged with the second plurality of electrical contact elements to exchange signals and/or data, wherein the first plug connector module has a locking arrangement that is motor-driven, as a result of which the first and second plug connector modules can be reversibly locked to one another with the first plurality of electrical contact elements engaged with the second plurality of electrical contact elements to exchange signals and/or data, and wherein the locking arrangement of the first plug connector module includes an elongate camshaft that extends longitudinally into a receiver of the second plug connector module when the first and second plug connector modules are plugged together.

2. The system as claimed in claim 1 wherein an axis of rotation of the camshaft is oriented parallel to a plug direction of the first plug connector module.

3. The system as claimed in claim 1 wherein the first plug connector module has an electric motor with which a rotational movement of the camshaft can be brought about.

4. The system as claimed in claim 1 wherein the first plug connector module has a pin which projects in a plug direction and in which the camshaft at least partially runs.

5. A system comprising a first plug connector module and a second plug connector module which can be plugged together, wherein:

the first plug connector module has a locking arrangement, as a result of which the plug connector modules can be reversibly locked to one another;

the locking arrangement comprises a camshaft;

the first plug connector module has a pin which projects in a plug direction and in which the camshaft at least partially runs; and the pin has at an end side at least one hole which runs transversely to a direction of extension of the pin.

6. The system as claimed in claim 5 wherein a ball is arranged in the hole.

7. The system as claimed in claim 6 wherein the second plug connector module has a receiver for the pin of the first plug connector module.

8. The system as claimed in claim 7 wherein the receiver has at least one hole which corresponds to the hole of the pin.

9. The system as claimed in claim 8 wherein the ball arranged in the pin of the first plug connector module can be pushed by a rotational movement of the camshaft at least partially into the hole located in the receiver of the second plug connector module, as a result of which the first plug connector module and the second plug connector module are locked to one another.

10. A system comprising a first plug connector module and a second plug connector module which can be plugged together, wherein:

the first plug connector module has a locking arrangement, as a result of which the plug connector modules can be reversibly locked to one another;

the locking arrangement comprises a camshaft; and the first plug connector module has at least two buttons, a first button and a second button.

11. The system as claimed in claim 10, wherein the first button is in touching contact with the camshaft if the first plug connector module and the second plug connector module are not locked to one another, and wherein the second button is in touching contact with the camshaft if the first plug connector module and the second plug connector module are locked together.

12. The system as claimed in claim 1 wherein the plug connector modules have in each case an interface, as a result of which, in the plugged together state, signals and/or data can be exchanged.

13. The system as claimed in claim 1 wherein the first plug connector module and/or the second plug connector module has/have an interface, as a result of which signals and/or data can be exchanged with a further adjacent plug connector module.

* * * * *